US008555859B2

(12) United States Patent
Wirrer

(10) Patent No.: US 8,555,859 B2
(45) Date of Patent: Oct. 15, 2013

(54) CIRCUIT ARRANGEMENT FOR CONTROLLING AN INJECTION VALVE

(75) Inventor: Gerhard Wirrer, Kallmünz (DE)

(73) Assignee: Continental Automotive GmbH, Hannover (DE)

( * ) Notice: Subject to any disclaimer, the term of this patent is extended or adjusted under 35 U.S.C. 154(b) by 329 days.

(21) Appl. No.: 13/001,819

(22) PCT Filed: Jan. 18, 2010

(86) PCT No.: PCT/EP2010/050531

§ 371 (c)(1),
(2), (4) Date: Dec. 29, 2010

(87) PCT Pub. No.: WO2010/084099

PCT Pub. Date: Jul. 29, 2010

(65) Prior Publication Data

US 2011/0283975 A1 Nov. 24, 2011

(30) Foreign Application Priority Data

Jan. 26, 2009 (DE) ..... 10 2009 006 179

(51) Int. Cl.
*F02M 51/00* (2006.01)

(52) U.S. Cl.
USPC ..... 123/478; 323/222; 361/154

(58) Field of Classification Search
USPC ..... 123/472, 476–478, 482, 487, 490, 299; 239/533.4; 251/129.05, 129.09, 129.1; 361/152–156, 160; 323/222, 266, 282, 323/283, 288, 223, 232, 290, 305, 363; 363/84, 88–90, 127
See application file for complete search history.

(56) References Cited

U.S. PATENT DOCUMENTS

| | | | | |
|---|---|---|---|---|
| 5,907,466 | A | 5/1999 | Dressler et al. | |
| 6,363,895 | B1 | 4/2002 | Butzmann et al. | |
| 6,431,155 | B1 * | 8/2002 | Yamakado et al. | 123/490 |
| 6,634,338 | B1 * | 10/2003 | Yamakado et al. | 123/490 |
| 7,621,259 | B2 | 11/2009 | Mayuzumi | |
| 8,020,533 | B2 * | 9/2011 | Tsuchiya et al. | 123/478 |
| 2002/0189593 | A1 * | 12/2002 | Yamakado et al. | 123/490 |
| 2004/0050977 | A1 | 3/2004 | Rieger et al. | |
| 2004/0108395 | A1 * | 6/2004 | Hamada et al. | 239/585.1 |

(Continued)

FOREIGN PATENT DOCUMENTS

| | | | |
|---|---|---|---|
| DE | 3833079 | A1 | 4/1990 |
| DE | 196 17 264 | A1 | 3/1997 |

(Continued)

OTHER PUBLICATIONS

Written Opinion of the International Searching Authority.

*Primary Examiner* — John Kwon
*Assistant Examiner* — Johnny Hoang
(74) *Attorney, Agent, or Firm* — Laurence A. Greenberg; Werner H. Stemer; Ralph E. Locher

(57) ABSTRACT

A circuit arrangement controls at least one injection valve, in particular a solenoid injection valve, for an internal combustion engine. The circuit includes a supply potential connection, a reference potential connection; one or more solenoids; a controllable voltage boosting circuit for generating from the first voltage a second voltage that is higher than the first voltage. The voltage boosting circuit is connected at a first input to the supply potential connection and at a first output to the solenoids by means of a respective first controllable semiconductor switching element. A control circuit is connected at least to a respective first semiconductor switching element and the voltage boosting circuit. The control circuit applies the first or the second voltage to the first coil connection of exactly one solenoid depending on an actuation state of one of the injection valves.

17 Claims, 4 Drawing Sheets

(56) References Cited

U.S. PATENT DOCUMENTS

| | | | | |
|---|---|---|---|---|
| 2005/0073795 | A1* | 4/2005 | Maekawa et al. | 361/160 |
| 2008/0083895 | A1* | 4/2008 | Ueda | 251/129.15 |
| 2009/0015223 | A1* | 1/2009 | Kakehi | 323/282 |

FOREIGN PATENT DOCUMENTS

| | | | |
|---|---|---|---|
| DE | 10242606 | A1 | 3/2004 |
| DE | 102006015003 | A1 | 10/2007 |
| DE | 19922485 | B4 | 6/2008 |
| DE | 10 2008 040 860 | A1 | 7/2009 |
| EP | 1 260 694 | A2 | 11/2002 |
| EP | 1415083 | B1 | 3/2008 |
| EP | 1923560 | A2 | 5/2008 |
| JP | 2001234793 | A | 8/2001 |
| JP | 2001351814 | A | 12/2001 |
| JP | 2002257000 | A | 9/2002 |
| JP | 2008115848 | A | 5/2008 |
| WO | 00/09867 | A1 | 2/2000 |

* cited by examiner

CIRCUIT ARRANGEMENT FOR CONTROLLING AN INJECTION VALVE

BACKGROUND OF THE INVENTION

Field of the Invention

The invention relates to a circuit arrangement for actuating at least one injection valve, particularly a solenoid injection valve, for an internal combustion engine.

In order to achieve an optimum combustion process, injection valves for internal combustion engines, what are known as SDI valves, need to be opened quickly at a precisely prescribed time, subsequently kept open and then closed. Besides the exact and rapid opening, the minimum and maximum injection quantity of fuel per pulse and also the ratio of the minimum and maximum injected quantities relative to one another ("spread") are relevant. In addition, consecutive pulses require a reproducible injected quantity to be attained with a high level of accuracy.

The minimum possible injected quantity together with a static flow of the fuel and also the regulatable fuel pressure range defines the possible spread for the injected quantity and hence the maximum possible power or engine speed for the given minimum quantity, e.g. when idling. The reduction in the minimum injected quantity allows multiple injections, particularly in the case of those injection strategies which produce injections close to an ignition time. This advantageously allows the emission behavior to be positively influenced. It is thus possible for soot to be avoided at average and high loads. Similarly, the response of a catalytic converter can be improved by an injection strategy which is optimized for catalytic converter heating.

The precise actuation of the injection valves is effected using a prescribed current profile, in which a cylinder coil associated with the injection valve has current applied to it. In order to open the valve, the cylinder coil has a high current applied to it. In order to keep the valve open and to minimize power loss, the valve is kept open with a lower current. When the current has been switched off and has reduced as quickly as possible in the cylinder coil, the valve closes by virtue of the force of a spring which keeps the valve closed in the rest state. Depending on the design of the valve, the spring force can be assisted by the fuel pressure.

In order to reduce the minimum injected quantity and injection time, the closing operation needs to be performed as quickly as possible. So as not to have to increase the spring force which needs to be overcome during the opening operation, solutions for actively closing the valve are known. These are known by the name "rapid injector closing" (RIC). This method involves an inverse current being built up in the cylinder coil for a short time during the closing operation in order to shut the valve under pressure.

A circuit arrangement for actuating two injection valves which is known from the prior art is shown in FIG. 1. The two injection valves each have an associated cylinder coil L1, L2 which can be connected to one another by means of their first coil connection SP1(L1), SP1(L2) and can be connected to a supply potential connection VP2 and a supply potential connection VP3, respectively, by means of a respective controllable semiconductor switching element T2, T9. The supply potential connection VP2 has a supply voltage of 70V applied to it which is produced by means of a DC/DC converter—not shown—from a vehicle onboard voltage of 12V and allows fast current buildup in both directions. The supply potential connection VP3 has the vehicle onboard voltage (12V) applied to it directly. The cylinder coils L1, L2 have their second coil connection SP2(L1), SP2(L2) coupled to a reference-ground potential connection BP via a respective controllable semiconductor switching element T1 or T5. The actuation of one of the semiconductor switching elements T1, T5 makes a selection regarding which of the cylinder coils and hence which injection element needs to be operated at a given time. The selection is made by virtue of the relevant semiconductor switching element T1, T5 being turned on, while the other semiconductor switching element is off. The level of the current flowing through the selected cylinder coil L1, L2 is adjusted by means of pulse width modulation using one of the semiconductor switching elements T2, T9.

During the opening operation for an injection valve, the first coil connection SP1(L1) or SP1(L2) of the selected injection valve has the operating voltage of 70V applied to it via the semiconductor switching element T2, said operating voltage being applied to the supply potential connection VP2. The high voltage is necessary in order to produce a sufficiently high current and a steep current rise in order to be able to overcome the valve force and the inertia of the injection valve in a short time. When the injection valve has opened completely, only relatively low currents are required, as explained at the outset, which means that the relevant first coil connection can be supplied with power from the vehicle onboard voltage via the supply potential connection VP3.

FIG. 1 shows a variant embodiment in which active closing of an injection valve is implemented. For this purpose, the second coil connections SP2(L1), SP2(L2) are connected to the supply potential connection VP2 via a respective semiconductor switching element T3, T4. Furthermore, the first coil connections SP1(L1), SP1(L2) are connected to the reference-ground potential connection BP via a further semiconductor switching element T8.

The semiconductor switching elements T3, T4, T8 could be replaced by diodes, provided that there is no provision for active closing in the circuit arrangement. In the embodiment shown in FIG. 1, the respective body diodes of the semiconductor switching elements T3, T4, T8, which are in the form of field-effect transistors, undertake the function of the diodes as freewheeling diodes when the flow of current through an activated cylinder coil is interrupted by means of the pulse width modulated semiconductor switching element T9.

The semiconductor switching element T8 can be used to connect the first coil connection SP1(L1), SP1(L2) of the activated cylinder coil L1, L2 to reference-ground potential, with the second coil connection SP2(L1), SP2(L2) of the activated cylinder coil L1, L2 being simultaneously connected to the supply potential connection VP2 (70V) by means of the associated semiconductor switching element T3 or T4. This makes it possible to produce the desired inverse, high current through the cylinder coil L1 or L2.

A drawback of the circuit arrangement shown in FIG. 1 is the circumstance that all the semiconductor switching elements (with the exception of the semiconductor switching element T9), the DC/DC converter and the capacitors contained therein need to be designed for 70V. These components are large, expensive and furthermore cannot be integrated on a semiconductor chip—or can be integrated thereon only with a large amount of complexity. Furthermore, the pulse width modulation requires current measurement to be performed using shunts (not shown in FIG. 1), since the preferred external sense FETs with the required accuracy are extraordinarily expensive.

BRIEF SUMMARY OF THE INVENTION

It is therefore an object of the present invention to specify a circuit arrangement for the actuation of at least one injection valve, particularly a solenoid injection valve, for an internal combustion engine, which circuit arrangement can be provided in a simpler and less expensive manner.

This object is achieved by a circuit arrangement having the claimed features. Advantageous embodiments can be found in the dependent patent claims.

The invention provides a circuit arrangement for the actuation of at least one injection valve, particularly a solenoid injection valve, for an internal combustion engine. Said circuit arrangement comprises a supply potential connection, on which it is possible to tap off a first voltage; a reference-ground potential connection; one or more cylinder coils, wherein for the purpose of operating an associated injection valve it is possible to apply a voltage to a first coil connection of the cylinder coil; a controllable voltage boosting circuit which is designed to take the first voltage and produce a second voltage which is higher than the first voltage, wherein the voltage boosting circuit has a first input connected to the supply potential connection and a first output connected via a respective first controllable semiconductor switching element to the cylinder coils; and an actuation circuit which, for the purpose of actuation, is connected at least to a respective semiconductor switching element and to the voltage boosting circuit, wherein the actuation circuit is designed to take an operated state of one of the injection valves as a basis for applying the first or the second voltage to the first coil connection of precisely one cylinder coil.

In comparison with the circuit arrangement known from the prior art, the circuit arrangement according to the invention allows the use of smaller and less expensive components. Furthermore, said components can be provided at a high level of integration density on a circuit carrier or for the most part in an integrated semiconductor chip. In comparison, only few discrete components are required. This is made possible by virtue of the supply potential connection merely being provided with a lower supply voltage in comparison with the prior art, which means that the DC/DC converter can also be of simpler and less expensive design.

In accordance with one expedient embodiment, the actuation circuit is designed such that, when there are a plurality of injection valves, only precisely one of the cylinder coils has the first or the second voltage applied to it at a given time by means of the actuation of the associated first switching element. The provision of a plurality of injection valves in a circuit arrangement according to the invention is also called a bank. A bank is a group of cylinders in which only one injection valve is permitted to be opened at a given time. The number of injection valves per bank is essentially dependent on the design of the internal combustion engine.

In accordance with a further expedient embodiment, the voltage boosting circuit is in the form of a known voltage doubler. This allows the voltage of 70V which is required for actuating an injection valve to be obtained from a voltage of 35V which is applied to the supply potential connection. This achieves the advantages already explained by way of introduction.

In a further embodiment, a second coil connection of the cylinder coil or coils is connected to the reference-ground potential connection via a first current measurement device, wherein this path can be broken by a fourth semiconductor switching element, which is different than the first current measurement device, or by the first current measurement device, which is in the form of a sense FET. The provision of a lower supply voltage in comparison with the prior art allows the use of integratable sense FETs, which are more reliable and less expensive than shunts.

Expediently, the first coil connection of a respective cylinder coil is connected to a second output of the voltage boosting circuit via a respective first rectification element such that the first rectification element allows the cylinder coil to freewheel when the flow of current through the cylinder coil is interrupted by means of the associated first semiconductor switching element. In the simplest variant, the first rectification element may be formed by a diode which allows the cylinder coil to freewheel. In this case, the cathode connection of the diode is connected to the first coil connection.

Advantageously, the first rectification element is formed by a second semiconductor switching element, which can be controlled by the actuation circuit, particularly a field-effect transistor (MOS-FET), wherein the rectification element is the body diode of the second semiconductor switching element. The embodiment of the rectification element as a controllable semiconductor switching element has the advantage that active closing (Rapid Injector Closing) of the injection valve is made possible. The second semiconductor switching element is connected to the first coil connection such that the cathode connection of the body diode is connected to the latter, so that the latter can undertake the functionality of the freewheeling diode.

In a further specific embodiment, the second coil connection is connected to the supply potential connection via a second rectification element. The second rectification element may, like the first rectification element, be formed by a simple diode which primarily serves the purpose of allowing one of the cylinder coils to freewheel when the flow of current through the cylinder coil is interrupted by means of the associated first semiconductor switching element. In this context, it is similarly expedient if the second rectification element is formed by a third semiconductor switching element, particular a sense FET, which can be controlled by the actuation circuit, wherein the rectification element is the body diode of the third semiconductor switching element. The embodiment of the third semiconductor switching element, particularly in the form of a sense FET, allows not only the freewheeling of the cylinder coil but also inexpensive and precise current measurement during the closing operation of the valve, which means that the current through the cylinder coil can be regulated with particular precision.

The first sense FET is used to perform current measurement when the injection element is opened or kept open. The second sense FET is used to perform current measurement during active closing of the injection element, the current being performed by virtue of appropriate pulse width modulation in the second semiconductor switching element.

In a further specific embodiment, the second coil connections of the plurality of cylinder coils are connected to one another.

In addition, the cylinder coil or coils and the respective first semiconductor switching elements and also the first rectification element(s) are in the form of discrete components and are designed for a dielectric strength for the second, high voltage. By contrast, the components of the voltage boosting circuit, the first current measurement device, optionally the fourth semiconductor switching element arranged in the current path of the first current measurement device, and the second rectification element are designed for a dielectric strength for the first voltage and can be integrated on a common semiconductor chip. This allows the inventive circuit arrangement to be produced with lower costs and lower space requirement in comparison with a conventional circuit arrangement. In particular, all components which are not directly associated with an injection element can be integrated on the common semiconductor chip, since these components are operated at a comparatively low voltage.

In a second embodiment, the actuation circuit has a switching device for pulse width modulation which is connected to the respective control connection of the controllable switching element for the purpose of adjusting a current through the respective cylinder coil. The pulse width modulation is preferably effected on the basis of a current measured by the sense FETs.

In accordance with a further expedient embodiment, the actuation circuit is designed to open an injection valve by applying the second voltage to the first coil connection of the associated cylinder coil and adjusting the current through the cylinder coil by virtue of pulse width modulation in the fourth semiconductor switching element, which is arranged in the current path of the first current measuring device, or by virtue of pulse width modulation in the first current measuring device (T2), which is in the form of a sense FET, by turning on the first semiconductor switching element and actuating the voltage boosting circuit a first time, with the current being measured by the first current measuring device. As can readily be seen, the first semiconductor switching element simultaneously selects the injection valve which is to be operated and performs the pulse width modulation for adjusting the current through the associated cylinder coil.

In accordance with a further embodiment, the actuation circuit is designed to maintain the opening of the injection valve by applying the first voltage to the first coil connection of the associated cylinder coil and adjusting the current through the cylinder coil by virtue of pulse width modulation in the first semiconductor switching element by turning on the first semiconductor switching element and actuating the voltage boosting circuit a second time, with the current being measured by the first current measuring device.

In a further embodiment, the actuation circuit is designed to close the injection valve by applying a third voltage, which is applied to the reference-ground potential connection, to the first coil connection of the associated cylinder coil and adjusting the current through the cylinder coil by virtue of pulse width modulation in the second semiconductor switching element by turning off the first semiconductor switching element and turning on the second semiconductor switching element and also actuating the voltage boosting circuit a second time, with the current being measured by the third semiconductor switching element. This actuation involves the selected injection valve being actively closed.

The invention is explained in more detail below with reference to an exemplary embodiment in the drawing, in which:

BRIEF DESCRIPTION OF THE SEVERAL VIEWS OF THE DRAWING

FIGS. 2A to 2C show a circuit arrangement according to the invention for actuating two injection valves, wherein FIGS. 2A to 2C are used to clarify different operating states of an injection valve.

DESCRIPTION OF THE INVENTION

Figure 1:
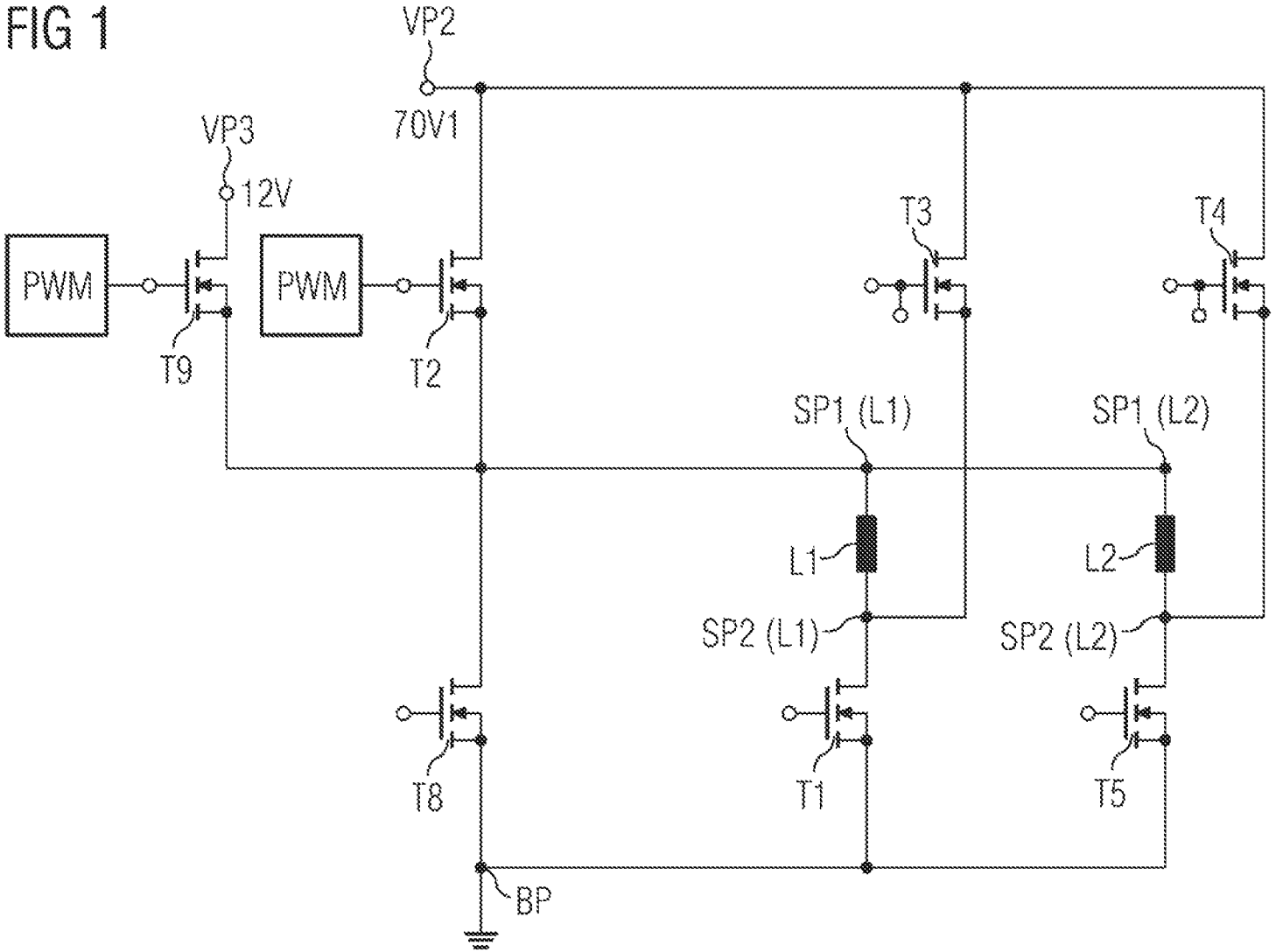
FIG. 1 shows a circuit arrangement known from the prior art for actuating two injection valves.
Figure 2A:
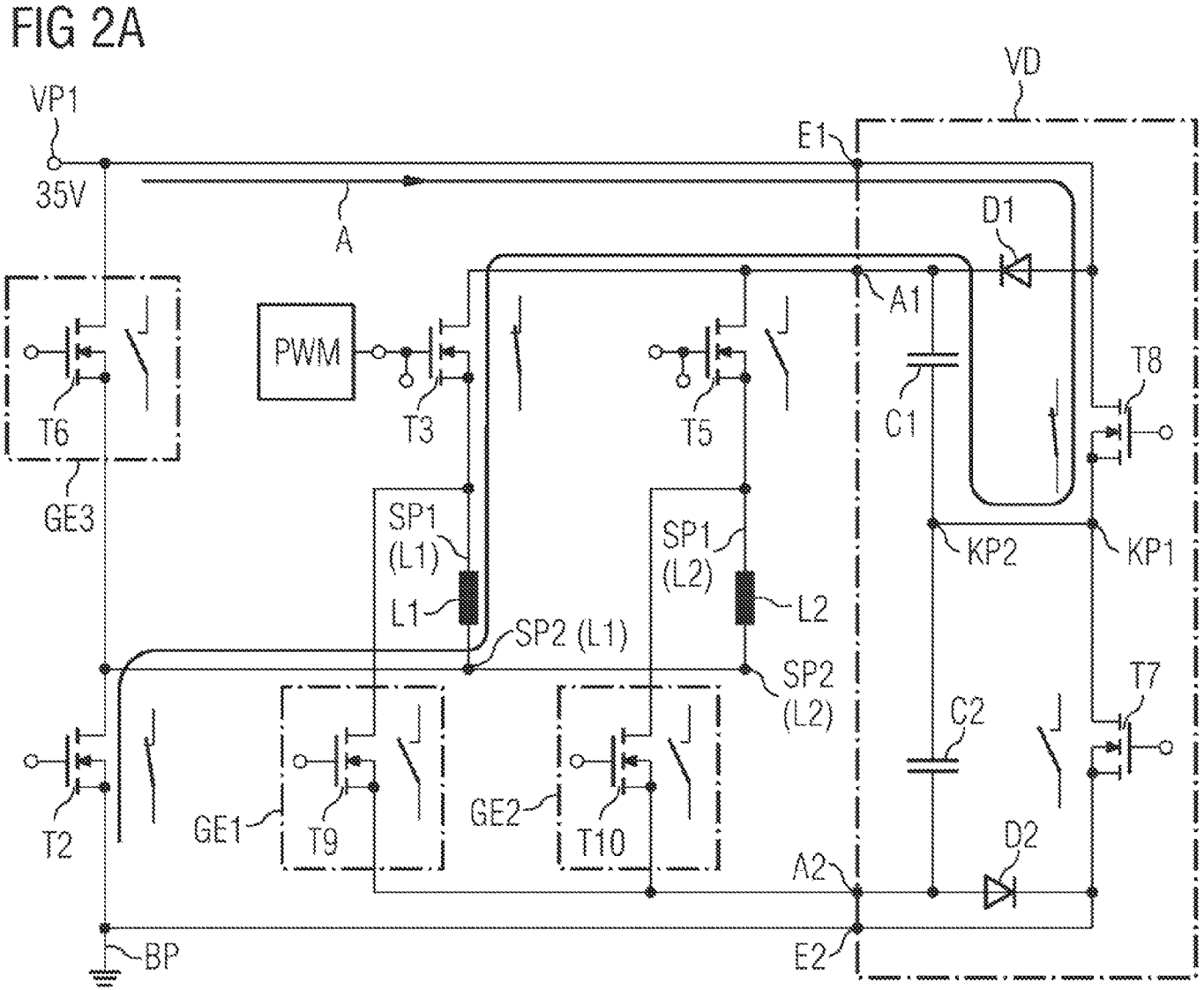
Figure 2B:
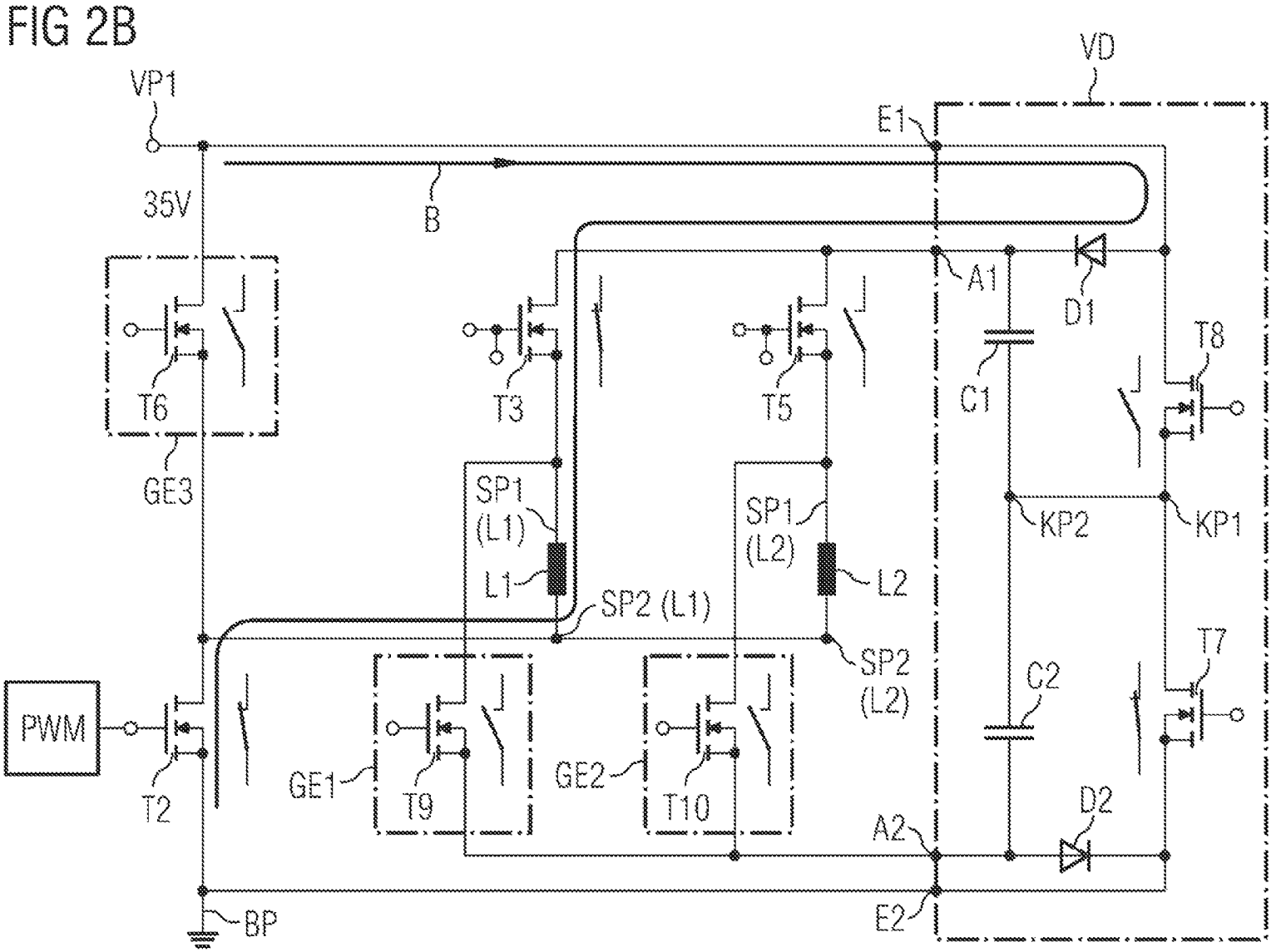
Figure 2C:
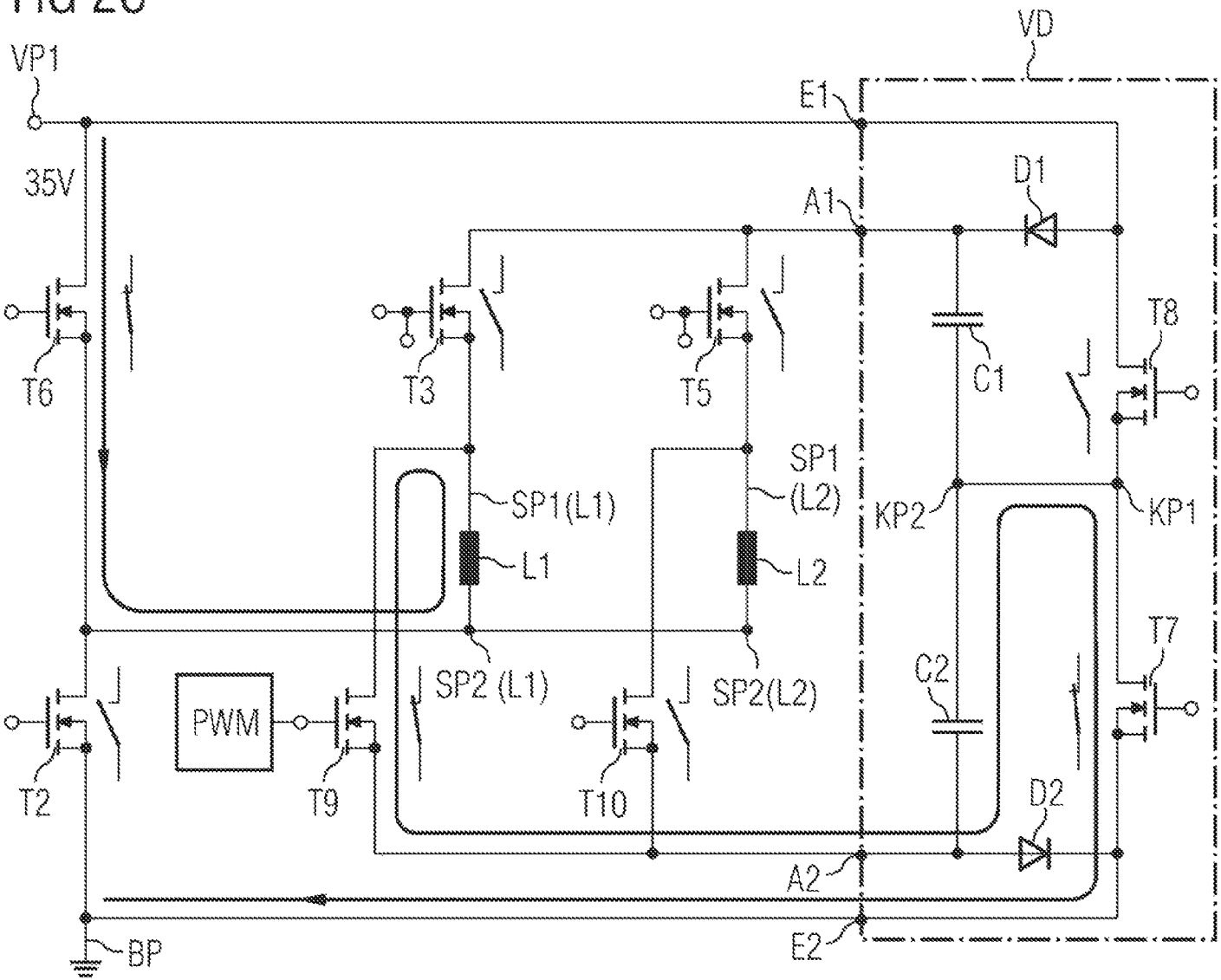

FIGS. 2A to 2C show an exemplary embodiment of a circuit arrangement according to the invention for actuating one or more injection valves, particularly solenoid injection valves, for an internal combustion engine. The circuit arrangement according to the invention exhibits the elements for actuating two injection valves, by way of example. The injection valves are arranged on a "bank", i.e. the cylinder coils associated with the injection valves are actuated together using one of their coil connections. This means that at a given time only a single injection valve is ever permitted to be operated, i.e. opened and closed again, by means of the circuit arrangement.

The circuit design in FIGS. 2A to 2C is identical. FIGS. 2A to 2C are used to explain different operating states or switching states.

The circuit arrangement according to the invention is distinguished by a single supply potential connection VP1 to which, by way of example, a voltage of 35V is applied. The voltage of 35V is produced from a vehicle onboard voltage of 12V by means of a DC/DC converter. The DC/DC converter is not shown in the figures. The supply potential connection VP1 is connected to a first input E1 of a voltage boosting circuit VD. A second input E2 of the voltage boosting circuit VD is connected to a reference-ground potential connection BP. The reference-ground potential connection BP is connected to ground potential. The voltage boosting circuit VD is designed to take the first voltage applied to the reference-ground potential connection VP1 and produce a second voltage, which is higher than the first voltage. In the exemplary embodiment, the voltage boosting circuit VD is in the form of a voltage doubler, but this is not imperative. Accordingly, a voltage of 70V can be provided at a first output A1. In the case of the topology shown, the voltage of 70V could also be produced using a lower voltage than 35V (i.e. less than half of the voltage of 70V which is to be achieved) if the controllable semiconductor switching elements are actuated in a suitable fashion.

In a known fashion, the voltage doubler comprises two semiconductor switching elements T7, T8 interconnected in series which are connected between the supply potential connection VP1 and the reference-ground potential connection BP. The control connections of the semiconductor switching elements T7, T8 are connected to a common actuation circuit—which is not shown in more detail in the figure. A node KP1 between the semiconductor switching elements T7, T8 is connected to a node KP2, to which respective first capacitor connections of capacitors C1, C2 are connected. The other connection of the capacitor C1 is connected to the first output A1 of the voltage doubler and to a cathode connection of a diode D1. The anode connection of the diode D1 is connected to the first input E1 of the voltage doubler. The other connection of the capacitor C2 is connected to the anode connection of a diode D2 and to a second output A2 of the voltage doubler. The cathode connection of the diode D2 is connected to the second input E2 and also to the semiconductor switching element T7.

Each of the injection valves has an associated cylinder coil L1, L2. A respective first coil connection SP1(L1), SP1(L2) is connected to the first output A1 of the voltage doubler VD via a controllable first semiconductor switching element T3 or T5. The respective second coil connections SP2(L1) and SP2 (L2) are coupled to one another and, via a first current measuring device in the form of a first sense FET T2, to the reference-ground potential connection BP. The first semiconductor switching elements T3, T5 and the sense FET T2 are in turn actuated by the common actuation circuit—which is not shown in the figure.

The actuation circuit ensures that at a given time only precisely one of the cylinder coils L1, L2 has the voltage which is applied to the first output A1 and is variable, depending on the operated state of the injection valve, applied to it by means of the actuation of the associated first switching element T3 or T5.

In order to allow an open injection valve to be actively closed, a respective first coil connection SP1(L1), SP1(L2) is connected to the second output A2 of the voltage doubler VD via a respective second semiconductor switching element T9, T10. At the same time, the second semiconductor switching elements T9, T10 allow the active cylinder coil to freewheel when the flow of current through the cylinder coil is interrupted by means of the associated first semiconductor switching element.

In order to be able to measure during the active closing and the inverse current which therefore flows in the relevant cylinder coil L1, L2, the second coil connections SP2(L1) and SP2(L2) and the supply potential connection VP1 have a second sense FET T6 connected between them. In addition to the possibility of being able to measure current and use it for actuation purposes, the second sense FET T6 also allows freewheeling of the cylinder coil via the body diode integrated therein.

If there is no provision for active closing of an open cylinder valve, the second semiconductor switching elements T9, T10 can be replaced by rectification elements GE1, GE2 in the form of a diode and the second sense FET T6 can be replaced by a further rectification element GE3 (e.g. similarly in the form of a diode). In this case, the cathode connections of the rectification elements GE1, GE2 are connected to a respective first coil connection SP1(L1), SP1(L2). The anode connections of the rectification elements GE1, GE2 are connected to one another and to the second output A2 of the voltage doubler. The anode connection of the rectification element GE3 would be connected to the second coil connections SP2(L1) and SP2(L2). The cathode connection of the rectification element GE3 would be connected to the supply potential connection VP1.

The actuation circuit already mentioned—and not shown in the figures—has, furthermore, a switching device for pulse width modulation PWM which actuates the first and second semiconductor switching elements or a sense FET, and hence allows current regulation through the active current path, in a manner which will be described in more detail below.

In order to explain the operational behavior, FIGS. 2A to 2C respectively show not only the illustrated semiconductor switching elements but also the open and closed states thereof within the context of the operation of an injection valve. In this case, it is assumed that the injection valve associated with the cylinder coil L1 is operated via the circuit arrangement.

FIG. 2A shows the situation for the provision of a current for opening the injection valve associated with the cylinder coil L1. The semiconductor switching elements T2, T3, T8 are on. The remaining semiconductor switching elements are off. The actuation circuit performs (following complete opening of the injection valve) pulse width modulation in the first semiconductor switching element T3. The current measurement which influences the pulse width modulation is performed using the first sense FET T2. The flow of current which is produced in the switch position shown in FIG. 2A is shown by the arrow labeled A.

By turning on the semiconductor switching element T8, the node KP2 is brought to a potential of 35V which corresponds to the supply potential connection VP1. The capacitor C1 charged to 35V therefore raises the voltage available at the first output A1 to 70V, so that when the first semiconductor switching element T3 is on a rapidly rising and high current can be routed through the cylinder coil L1. Once the inertia of the injection valve has been overcome and the injection valve has opened completely on account of the magnetic field produced by the cylinder coil L1, pulse width modulation takes place in the first semiconductor switching element T3, so that an approximately constant current through the cylinder coil L1 is produced. The current flowing as a result of the self-induced voltage of the cylinder coil L1 during the times at which the first semiconductor switching element T3 is off can be produced by means of the body diode of the semiconductor switching element T9 and the capacitor C2, so that the following current path is obtained: T8-C2-T9-L1-T2.

FIG. 2B shows the state of the semiconductor switching elements for the provision of a holding current, which is low in comparison with the opening current, for which only a force which corresponds to the spring force of the injection valve needs to be applied by the cylinder coil L1. To this end, it is sufficient if the first coil connection SP1(L1) has a voltage of just 35V applied to it, which can be provided by the supply potential connection 1. During this operated state, the semiconductor switching element T2, T3, T7 are on. The other semiconductor switching elements T6, T8, T9 are off. Pulse width modulation is effected by means of the first semiconductor switching element T3. The current measurement is in turn effected by means of the semiconductor switching element T2. The flow of current obtained during this operated state is labeled B.

On account of the supply voltage of 35V—which is lower in comparison with the situation in FIG. 2A-*on* the first coil connection SP1(L1) and the pulse width modulation on the semiconductor switch T2, a reduced current in comparison with opening is obtained for the cylinder coil L1. The self-induced voltage caused by the opening and closing of the sense FET T2 in the cylinder coil L1 and the resultant enforced coil current can flow via the diode D1, the body diode of the open semiconductor switching element T6, the coil L1 and also via the semiconductor switching element T3 which is on, so that the following current path is obtained: D1-T3-L1-T6. Since the sense FET T2 cannot measure the current flowing through it during the pulse width modulation, said sense FET is turned off for a respective fixed time during this.

FIG. 2C shows the situation during active closing of the injection valve which is associated with the cylinder coil L1. In this case, the semiconductor switching elements T6, T7 and T9 are on. The remaining semiconductor switching elements T2, T3 and T8 are off. The pulse width modulation is now effected by means of the second semiconductor switching element T9. If current measurement is required, this is performed by means of the second sense FET T6. The resultant current path through the cylinder coil L1 is labeled C.

On account of the semiconductor switching element T9 and the semiconductor switching element T7 being turned on, the first coil connection SP1(L1) is connected to the reference-ground potential, while the second coil connection SP2 (L1) has the 35V from the supply potential connection VP1 applied to it via the sense FET T6. This results in an inverse current through the cylinder coil L1, which current speeds up the closing of the injection valve. In order to disconnect the current flowing through the cylinder coil L1, the semiconductor switch T9 is opened. In order to allow the cylinder coil L1 or the cylinder coil L2 to be opened again, the semiconductor switching element T8 is furthermore closed and the semiconductor switching element T7 is opened.

Freewheeling of the current in the cylinder coil L1 on account of the pulse width modulation in T9 is made possible by the current path T3-C1-T8-T6.

As can readily be seen from the circuit topology and the functional description, the circuit arrangement requires just two 70V transistors per cylinder coil (T3 and T9 or T5 and T10) in order to actuate one or more injection valves. All the other semiconductor switching elements (T2, T6, T7, T8) can be designed for 35V and hence easily integrated into a common semiconductor chip. The semiconductor switching elements T9 and T10 and the relevant diodes likewise need to be designed for a dielectric strength of 70V, provided that the circuit arrangement has no provision for active closing.

The semiconductor switching elements T2, T6, T7 and T8 which are just designed for 35V can therefore be integrated on a common semiconductor chip with the actuation circuit. In particular, it is also possible to design the capacitors C1 and C2 and also the capacitors which are needed in the DC/DC converter for 35V, so that it may be possible for the components of the DC/DC converter likewise to be integrated into this semiconductor chip.

Since the integrated sense FETs T2, T6 provided for current measurement also need to be designed only for a dielectric strength of 35V, it is possible for the current measurement to be performed with a high level of accuracy and at low cost.

If a high power loss is produced in the circuit arrangement as a result of the operation of the cylinder coil, it is possible for a power resistor to be provided between the nodes KP1 and KP2 in the voltage doubler. This allows a significant amount of power loss to be removed from a semiconductor chip.

The invention therefore allows a bank of injection valves to be actuated more easily and less expensively.

The invention claimed is:

1. A circuit arrangement for actuating at least one injection valve of an internal combustion engine, the circuit arrangement comprising:

a supply potential connection for carrying a first voltage;

a reference-ground potential connection;

at least one cylinder coil having a first coil connection and a second coil connection, wherein a voltage is applied to said first coil connection of said cylinder coil for operating an associated injection valve;

a controllable voltage doubling circuit configured to produce from the first voltage a second voltage that is higher than the first voltage, said voltage doubling circuit having a first input connected to said supply potential connection, said voltage doubling circuit including a second input connected to said reference-ground potential connection, said voltage doubling circuit including two semiconductor elements connected in series with each other and connected between said supply voltage connection and said reference-ground potential connection, each one of said two semiconductor switching elements having a control connection, said voltage doubling circuit including a first output, a second output, a first diode, a first capacitor, a second capacitor, a second diode, a first node connected between said two semiconductor switching elements, and a second node, said first diode, said first capacitor, said second capacitor, and said second diode connected in series to thereby form a series circuit having a center tap at said second node said series circuit connected between said supply potential connection and said reference-ground connection, said voltage doubling circuit including a first output formed by a connecting point between said first diode and said first capacitor, said voltage doubling circuit including a second output formed by a connecting point between said second capacitor and said second diode, and said voltage doubling circuit including a first controllable semiconductor element connecting said first output to said cylinder coil;

an actuation circuit connected to said control connection of each one of said two semiconductor switching elements;

a first current measurement device connecting said second coil connection of said at least one cylinder coil to said reference-ground potential connection; and a component selected from the group consisting of: said first current measuring device and a fourth semiconductor switching element being different from said first current measurement device, said component selectively breaking a connection between said second coil connection and said reference-ground potential connection.

2. The circuit arrangement according to claim 1, wherein the at least one injection valve is one of a plurality of injection valves, and said actuation circuit is configured to ensure that, at a given time, only precisely one of said cylinder coils has the first or the second voltage applied thereto by way of an actuation of an associated said first switching element.

3. The circuit arrangement according to claim 1, wherein said first rectification element is a second semiconductor switching element, controlled by said actuation circuit, and wherein said rectification element is a body diode of said second semiconductor switching element.

4. The circuit arrangement according to claim 1, wherein said at least one cylinder coil has a second coil connection connected to said supply potential connection via a second rectification element.

5. The circuit arrangement according to claim 4, wherein said second rectification element comprises a third semiconductor switching element, controlled by said actuation circuit, and wherein said rectification element is a body diode of said third semiconductor switching element.

6. The circuit arrangement according to claim 1, further comprising a plurality of cylinder coils having second coil connections connected together.

7. The circuit arrangement according to claim 1, wherein said cylinder coil or cylinder coils and the respective said first semiconductor switching elements and also said first rectification element or elements are discrete components and are configured for a dielectric strength for the second voltage.

8. The circuit arrangement according to claim 1, wherein the components of said voltage doubling circuit, said first current measurement device, an optional fourth semiconductor switching element connected in a current path of said first current measurement device, and said second rectification element are configured for a dielectric strength for the first voltage and integrated on a common semiconductor chip.

9. The circuit arrangement according to claim 1, wherein said actuation circuit has a switching device for pulse width modulation connected to a respective control connection of said controllable switching element for adjusting a current flowing through the respective said cylinder coil.

10. The circuit arrangement according to claim 1, wherein said actuation circuit is configured to open an injection valve by applying the second voltage to said first coil connection of the associated cylinder coil and to adjust a current through the cylinder coil by virtue of pulse width modulation in said first semiconductor switching element by turning on said first semiconductor switching element and actuating said voltage doubling circuit a first time, with the current being measured by said first current measurement device.

11. The circuit arrangement according to claim 1, wherein said actuation circuit is configured to maintain an opening of the injection valve by applying the first voltage to said first coil connection of the associated cylinder coil and to adjust a current through the cylinder coil by virtue of pulse width modulation in a fourth semiconductor switching element, which is connected in a current path of said first current measurement device, or by virtue of pulse width modulation in said first current measurement device, which is embodied as a sense FET, by turning on said first semiconductor switching element and actuating said voltage doubling circuit a second time, with the current being measured by said first current measurement device.

12. The circuit arrangement according to claim 1, wherein said actuation circuit is configured to close the injection valve by applying a third voltage, which is applied to said reference-ground potential connection, to said first coil connection of the associated cylinder coil and adjust a current through the cylinder coil by virtue of pulse width modulation in a second semiconductor switching element by turning off said first semiconductor switching element and turning on said second semiconductor switching element and also actuating said voltage doubling circuit a second time, with the current being measured by a third semiconductor switching element.

13. The circuit arrangement according to claim 3, wherein said actuation circuit is configured to close the injection valve by applying a third voltage, which is applied to said reference-ground potential connection, to said first coil connection of the associated cylinder coil and adjust a current through the cylinder coil by virtue of pulse width modulation in said second semiconductor switching element by turning off said first semiconductor switching element and turning on said second semiconductor switching element and also actuating said voltage doubling circuit a second time, with the current being measured by a third semiconductor switching element.

14. The circuit arrangement according to claim 5, wherein said actuation circuit is configured to close the injection valve by applying a third voltage, which is applied to said reference-ground potential connection, to said first coil connection of the associated cylinder coil and adjust a current through the cylinder coil by virtue of pulse width modulation in said second semiconductor switching element by turning off said first semiconductor switching element and turning on said second semiconductor switching element and also actuating said voltage doubling circuit a second time, with the current being measured by a third semiconductor switching element.

15. The circuit arrangement according to claim 1, configured for operating a solenoid injection valve of an internal combustion engine.

16. The circuit arrangement according to claim 1, wherein said component is selected to be said first current measuring device, and said first current measuring device is formed as a sense FET.

17. The circuit arrangement according to claim 1, wherein said component is selected to be said fourth semiconductor switching element.

* * * * *